US010758791B2

(12) United States Patent
Norimura

(10) Patent No.: US 10,758,791 B2
(45) Date of Patent: Sep. 1, 2020

(54) IRON-TYPE GOLF CLUB HEAD

(71) Applicant: Dunlop Sports Co. Ltd., Kobe-shi, Hyogo (JP)

(72) Inventor: Takahiro Norimura, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 173 days.

(21) Appl. No.: 15/172,817

(22) Filed: Jun. 3, 2016

(65) Prior Publication Data

US 2016/0354649 A1 Dec. 8, 2016

(30) Foreign Application Priority Data

Jun. 4, 2015 (JP) ..... 2015-113659

(51) Int. Cl.
*A63B 53/04* (2015.01)

(52) U.S. Cl.
CPC ..... *A63B 53/047* (2013.01); *A63B 2053/042* (2013.01); *A63B 2053/0408* (2013.01)

(58) Field of Classification Search
CPC ..... A63B 53/047; A63B 2053/0416; A63B 53/042; A63B 2053/0425; A63B 2053/0429
USPC ..... 473/324–350
See application file for complete search history.

(56) References Cited

U.S. PATENT DOCUMENTS

| | | | | |
|---|---|---|---|---|
| 819,900 | A * | 5/1906 | Martin | A63B 53/0466 473/329 |
| 2,034,936 | A * | 3/1936 | Barnhart | A63B 53/04 473/329 |
| 6,093,112 | A * | 7/2000 | Peters | A63B 53/00 473/291 |
| 6,248,025 | B1 * | 6/2001 | Murphy | A63B 53/04 473/324 |
| 6,390,933 | B1 * | 5/2002 | Galloway | A63B 53/02 473/290 |
| 6,398,666 | B1 * | 6/2002 | Evans | A63B 53/02 473/345 |
| 6,482,104 | B1 * | 11/2002 | Gilbert | A63B 53/04 473/287 |
| 6,602,149 | B1 * | 8/2003 | Jacobson | A63B 53/04 473/329 |

(Continued)

FOREIGN PATENT DOCUMENTS

| | | |
|---|---|---|
| JP | 2008-149964 A | 6/2006 |
| JP | 2012-166093 A | 9/2012 |
| JP | 2013-59680 A | 4/2013 |

*Primary Examiner* — William M Pierce

(74) *Attorney, Agent, or Firm* — Birch, Stewart, Kolasch & Birch, LLP

(57) ABSTRACT

An iron clubs golf club head 1 comprises a face plate and a head main body supporting a peripheral part of the face plate. The face plate is made of a titanium or a titanium alloy and provided on the club face with grooves. The head main body is made of a metal material having a specific gravity larger than that of the face plate. In a grooved range defined between positions in the toe-heel direction of the most toe-side end and most heel-side end of grooves of the face plate, a distance of at least part of a sole-side edge of the face plate is not more than 2.5 mm when measured from a sole-side profile line of the club head appearing in the front view of the club head, in the up-down direction of the club head.

8 Claims, 11 Drawing Sheets

(56) References Cited

U.S. PATENT DOCUMENTS

D481,432 S * 10/2003 Greene ..... D21/748
D490,129 S * 5/2004 Greene ..... D21/748
6,923,733 B2 * 8/2005 Chen ..... A63B 53/047 473/305
7,121,958 B2 * 10/2006 Cheng ..... A63B 53/047 473/345
7,261,643 B2 * 8/2007 Rice ..... G01N 29/045 473/329
7,367,899 B2 * 5/2008 Rice ..... A63B 53/0466 473/329
7,491,135 B1 * 2/2009 Rollinson ..... A63B 53/0487 473/342
7,578,754 B2 * 8/2009 Nakamura ..... A63B 53/047 473/342
7,614,962 B1 * 11/2009 Clausen ..... A63B 53/047 473/291
7,704,162 B2 * 4/2010 Rice ..... G01N 29/045 473/329
8,398,506 B2 * 3/2013 Stites ..... A63B 53/0466 473/345
9,033,817 B2 * 5/2015 Snyder ..... A63B 53/047 473/324
9,700,766 B2 * 7/2017 Sugimae ..... A63B 53/0466
9,737,770 B2 * 8/2017 Bennett ..... A63B 53/0466
9,776,059 B1 * 10/2017 Buday ..... A63B 53/0466
9,884,230 B2 * 2/2018 Snyder ..... A63B 53/047
9,901,792 B2 * 2/2018 Franklin ..... A63B 53/04
9,937,390 B2 * 4/2018 Luttrell ..... A63B 53/04
9,950,219 B2 * 4/2018 Larson ..... A63B 53/0466
10,039,966 B2 * 8/2018 Kohno ..... A63B 60/54
10,046,211 B2 * 8/2018 Franklin ..... A63B 53/0487
10,543,409 B2 * 1/2020 Demkowski ..... A63B 60/52
2001/0001302 A1 * 5/2001 Murphy ..... A63B 53/04 473/345
2001/0055995 A1 * 12/2001 Cackett ..... A63B 53/02 473/342
2002/0010034 A1 * 1/2002 Reyes ..... A63B 53/02 473/345
2002/0049097 A1 * 4/2002 Murphy ..... A63B 53/04 473/345
2002/0103041 A1 * 8/2002 Murphy ..... A63B 53/04 473/345
2003/0064823 A1 * 4/2003 Yamamoto ..... A63B 53/04 473/329
2003/0228928 A1 * 12/2003 Yabu ..... A63B 53/04 473/290
2004/0198533 A1 * 10/2004 Mitsuba ..... A63B 53/04 473/349
2004/0242339 A1 * 12/2004 Gilbert ..... A63B 53/04 473/291
2006/0068935 A1 * 3/2006 Tang ..... A63B 53/0487 473/340
2006/0116218 A1 * 6/2006 Burnett ..... A63B 53/0466 473/349
2006/0116219 A1 6/2006 Hirano
2006/0194645 A1 * 8/2006 Sugimoto ..... A63B 53/047 473/342
2006/0240908 A1 * 10/2006 Adams ..... A63B 53/0466 473/334
2006/0281582 A1 * 12/2006 Sugimoto ..... A63B 53/047 473/346
2007/0054751 A1 * 3/2007 Breier ..... A63B 53/04 473/334
2007/0178988 A1 * 8/2007 Tavares ..... A63B 53/04 473/334
2008/0020861 A1 * 1/2008 Adams ..... A63B 53/04 473/334
2008/0039228 A1 * 2/2008 Breier ..... A63B 53/04 473/334
2008/0058119 A1 * 3/2008 Soracco ..... A63B 53/04 473/350
2008/0146370 A1 * 6/2008 Beach ..... A63B 53/0466 473/336
2009/0029796 A1 * 1/2009 Mergy ..... A63B 53/047 473/331
2009/0137339 A1 * 5/2009 Nakano ..... A63B 53/0475 473/350
2009/0305815 A1 * 12/2009 Hirano ..... A63B 53/047 473/350
2010/0029406 A1 * 2/2010 Stites ..... A63B 53/047 473/334
2010/0087269 A1 * 4/2010 Snyder ..... A63B 53/04 473/329
2010/0105499 A1 * 4/2010 Roach ..... A63B 53/04 473/335
2010/0273570 A1 * 10/2010 Ines ..... A63B 53/047 473/342
2011/0207551 A1 * 8/2011 Breier ..... A63B 53/047 473/332
2011/0256957 A1 * 10/2011 Roach ..... A63B 53/047 473/332
2012/0021849 A1 * 1/2012 Gibbs ..... A63B 53/0466 473/342
2012/0034991 A1 * 2/2012 Hartwell ..... A63B 53/047 473/290
2012/0064995 A1 * 3/2012 Morin ..... A63B 53/047 473/349
2012/0122606 A1 * 5/2012 Yamamoto ..... A63B 53/047 473/332
2012/0157222 A1 * 6/2012 Kii ..... A63B 53/00 473/290
2012/0172144 A1 * 7/2012 Mazutani ..... A63B 59/0092 473/332
2012/0202615 A1 * 8/2012 Beach ..... A63B 53/06 473/338
2012/0289360 A1 * 11/2012 Breier ..... A63B 53/047 473/335
2013/0017903 A1 * 1/2013 Takechi ..... A63B 53/047 473/332
2013/0035178 A1 * 2/2013 Roach ..... A63B 53/06 473/345
2013/0281227 A1 * 10/2013 Roach ..... A63B 53/0475 473/332
2013/0310192 A1 * 11/2013 Wahl ..... C25D 1/00 473/331
2013/0331201 A1 * 12/2013 Wahl ..... A63B 60/00 473/329
2013/0344989 A1 * 12/2013 Hebreo ..... A63B 60/02 473/349
2014/0038747 A1 * 2/2014 Dolezel ..... A63B 53/047 473/342
2014/0073447 A1 * 3/2014 Golden ..... A63B 53/047 473/291
2014/0274442 A1 * 9/2014 Honea ..... A63B 53/047 473/291
2014/0274454 A1 * 9/2014 Snyder ..... A63B 53/047 473/332
2015/0038263 A1 * 2/2015 Ueda ..... A63B 53/04 473/349
2015/0051013 A1 * 2/2015 Ueda ..... A63B 53/047 473/342
2015/0057101 A1 * 2/2015 Sander ..... A63B 53/047 473/342
2015/0217364 A1 * 8/2015 Zimmerman ..... B21K 17/00 72/352
2016/0059093 A1 * 3/2016 Nielson ..... A63B 53/02 473/338
2016/0101330 A1 * 4/2016 Harrington ..... A63B 53/047 473/338
2016/0184669 A1 * 6/2016 Deshmukh ..... A63B 53/0475 473/335
2016/0193508 A1 * 7/2016 Issertell ..... A63B 60/52 473/342
2016/0243413 A1 * 8/2016 Ritchie ..... A63B 53/047
2017/0028270 A1 * 2/2017 Westrum ..... A63B 53/047
2017/0113103 A1 * 4/2017 Nakamura ..... A63B 53/047
2017/0113106 A1 * 4/2017 Norimura ..... A63B 53/0475

(56) References Cited

U.S. PATENT DOCUMENTS

| | | | | |
|---|---|---|---|---|
| 2017/0113107 | A1* | 4/2017 | Sugimoto | A63B 53/047 |
| 2017/0113109 | A1* | 4/2017 | Kohno | A63B 60/54 |
| 2017/0173410 | A1* | 6/2017 | Nakamura | A63B 53/047 |
| 2017/0182385 | A1* | 6/2017 | Wu | A63B 53/06 |
| 2017/0239533 | A1* | 8/2017 | Cole | A63B 53/0475 |
| 2017/0312593 | A1* | 11/2017 | Myers | A63B 53/0466 |
| 2018/0001169 | A1* | 1/2018 | Abe | A63B 60/02 |
| 2018/0050241 | A1* | 2/2018 | Su | A63B 53/047 |
| 2018/0056148 | A1* | 3/2018 | Honea | A63B 60/54 |

* cited by examiner

IRON-TYPE GOLF CLUB HEAD

BACKGROUND OF THE INVENTION

The present invention relates to a golf club head, more particularly to an iron-type golf club whose club face is improved in the rebound performance in a sole-side region of the club face.

The following patent documents 1-3 disclose iron-type golf club heads comprising a face plate forming a club face for hitting a ball, and a head main body supporting a peripheral part of the face plate. Accordingly, these iron-type golf club heads are constructed such that the central part of the club face can easily deflect and exhibits high rebound performance. On the other hand, the iron-type golf club heads have a tendency that the rebound performance decreases toward the sole from the central part of the club face.

Patent document 1: Japanese Patent Application Publication No. 2012-166093

Patent document 2: Japanese Patent Application Publication No. 2013-59680

Patent document 3: Japanese Patent Application Publication No. 2006-149964

SUMMARY OF THE INVENTION

In general, an iron-type golf club has many opportunities to hit a ball lying on lawn, therefore, the ball hitting position tends to become on the sole-side (under side) of the center of the club face. In other words, there is a tendency that a ball is hit at a sole-side position where the rebound performance is relatively low.

Thus, the iron-type golf club heads disclosed in the patent documents 1-3 have a room for improvement in order to increase the carry distance of the ball.

It is therefore, an object of the present invention to provide an iron-type golf club head, in which the club face can exhibit high rebound performance in the central region as well as in a sole-side region of the club face.

According to the present invention, an iron-type golf club head having a club face for hitting a ball and a sole forming an under surface of the club head, comprises:

a face plate made of a titanium or a titanium alloy, and a head main body made of a metal material having a specific gravity larger than that of the face plate and supporting a peripheral part of the face plate, wherein the face plate is provide with a plurality of grooves extending in the toe-heel direction of the club head, in a grooved range in the toe-heel direction which is defined between a position in the toe-heel direction of the most toe-side end of the grooves and a position in the toe-heel direction of the most heel-side end of the grooves, a distance of at least part of a sole-side edge of the face plate is not more than 2.5 mm when measured in the up-down direction from a sole-side profile line of the club head appearing in a front view of the club head under the upright state.

Definitions

In this application, dimensions, positions, directions and the like relating to the club head refer to those under a standard state of the club head unless otherwise noted.

Here, the standard state of the club head is such that the club head is set on a horizontal plane HP so that the axis of the club shaft (not shown) is inclined at the specified lie angle while keeping the axis on a vertical plane, and the club face forms the specified loft angle. Incidentally, in the case of the club head alone, the center line of the shaft inserting hole can be used instead of the axis of the club shaft.

The toe-heel direction is a direction parallel with the horizontal plane HP and perpendicular to a front-back direction.

The front-back direction is a direction parallel with a straight line projected on the horizontal plane HP, wherein the straight line is drawn normally to the club face passing through the center of gravity G of the club head.

The sole-side profile line of the club head means the profile line of the sole of the club head appearing when the club head is viewed from the front of the club head under the upright state as shown in FIG. 1.

The upright state of the club head is such that the club head under the standard state as shown in FIG. 4 is rotated around a horizontal axis extending along the club face so that the loft angle alpha becomes 0 degree as shown in FIG. 3.

The iron-type golf club according to the present invention may further include the following features (1)-(7):

(1) the above-mentioned at least part of the sole-side edge extends in the toe-heel direction across the center in the toe-heel direction of the grooved range;

(2) the distance is not more than 2.4 mm;

(3) the sole-side edge includes a linear part extending linearly along the toe-heel direction, and in the grooved range, the distance of the sole-side edge in the linear part is not more than 2.5 mm over the entire length of the linear part;

(4) the distance of the sole-side edge in the linear part is gradually decreased from the center of the linear part in the toe-heel direction toward the toe-side end of the linear part and toward the heel-side end of the linear part;

(5) the distance of the sole-side edge in the linear part is not more than 2.0 mm at the toe-side end of the linear part, and not more than 2.0 mm at the heel-side end of the linear part;

(6) in the grooved range, at least part of the sole-side edge of the face plate forms the sole-side profile line;

(7) the face plate has, on its sole-side, a contact surface with the head main body, and a height (Q) of an upper edge of the contact surface from the sole-side edge is in a range of from 0.8 to 2.2 mm when measured in the up-down direction in the front view of the club head under the upright state.

Therefore, in the iron-type golf club head according to the present invention, as the face plate is made of a titanium or a titanium alloy and excels in the rebound characteristic when hitting a ball, the club head may exert high rebound performance.

Further, as the distance of the sole-side edge is not more than 2.5 mm, the face plate which excels in the rebound characteristic is enlarged toward the sole, and the rebound performance in a sole-side region of the club face can be effectively improved.

DESCRIPTION OF THE PREFERRED EMBODIMENTS

Embodiments of the present invention will now be described in detail in conjunction with accompanying drawings.

In the following embodiments, the lie angle is preferably set in a range of from 50 to 70 degrees, and the loft angle is preferably set in a range of from 15 to 70 degrees. But, the lie angle and the loft angle are not necessarily limited to these ranges.

Figure 1:
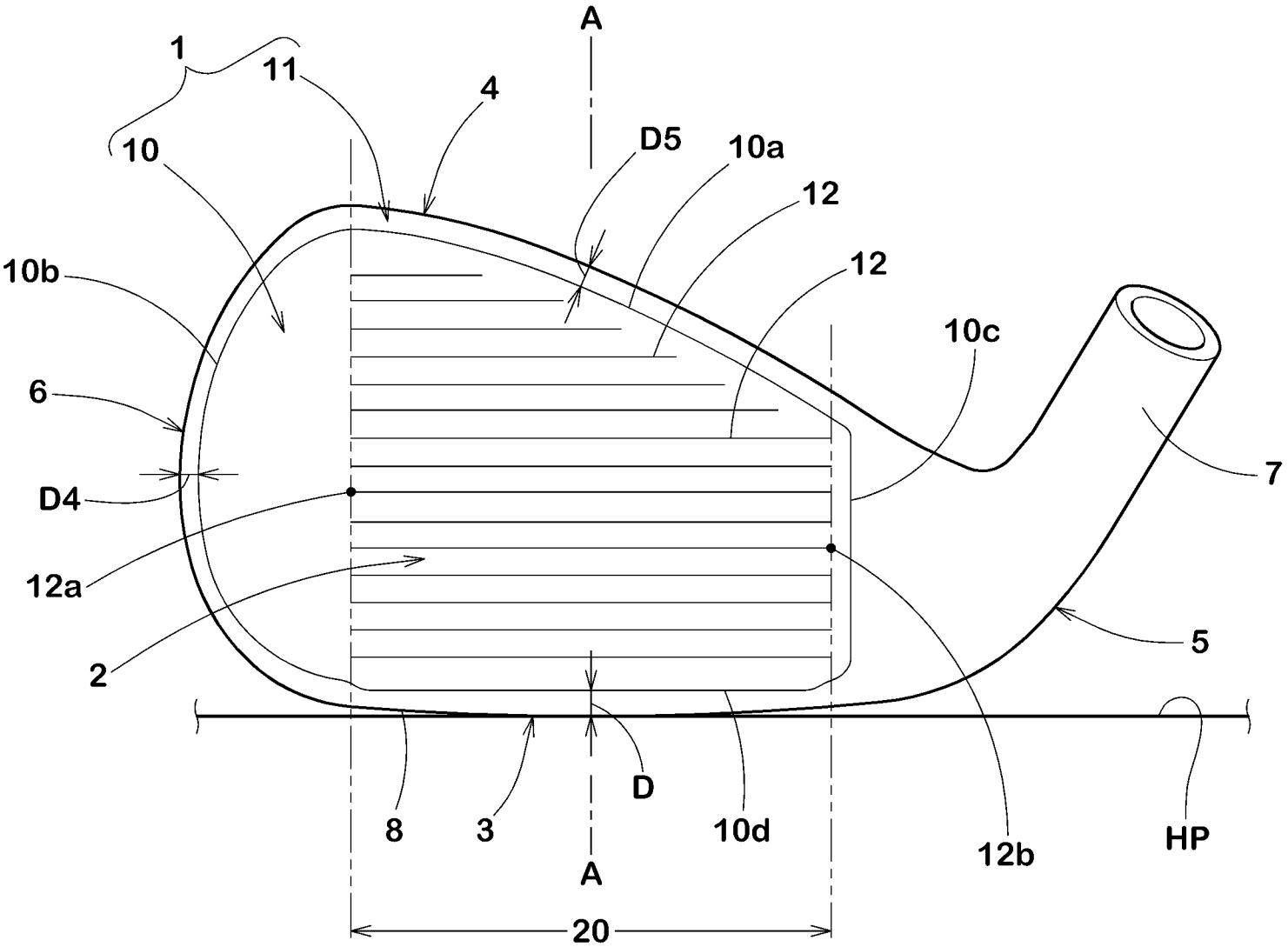
FIG. 1 is a front view of an iron-type golf club head as a first embodiment of the present invention under the upright state of the club head.
Figure 2:
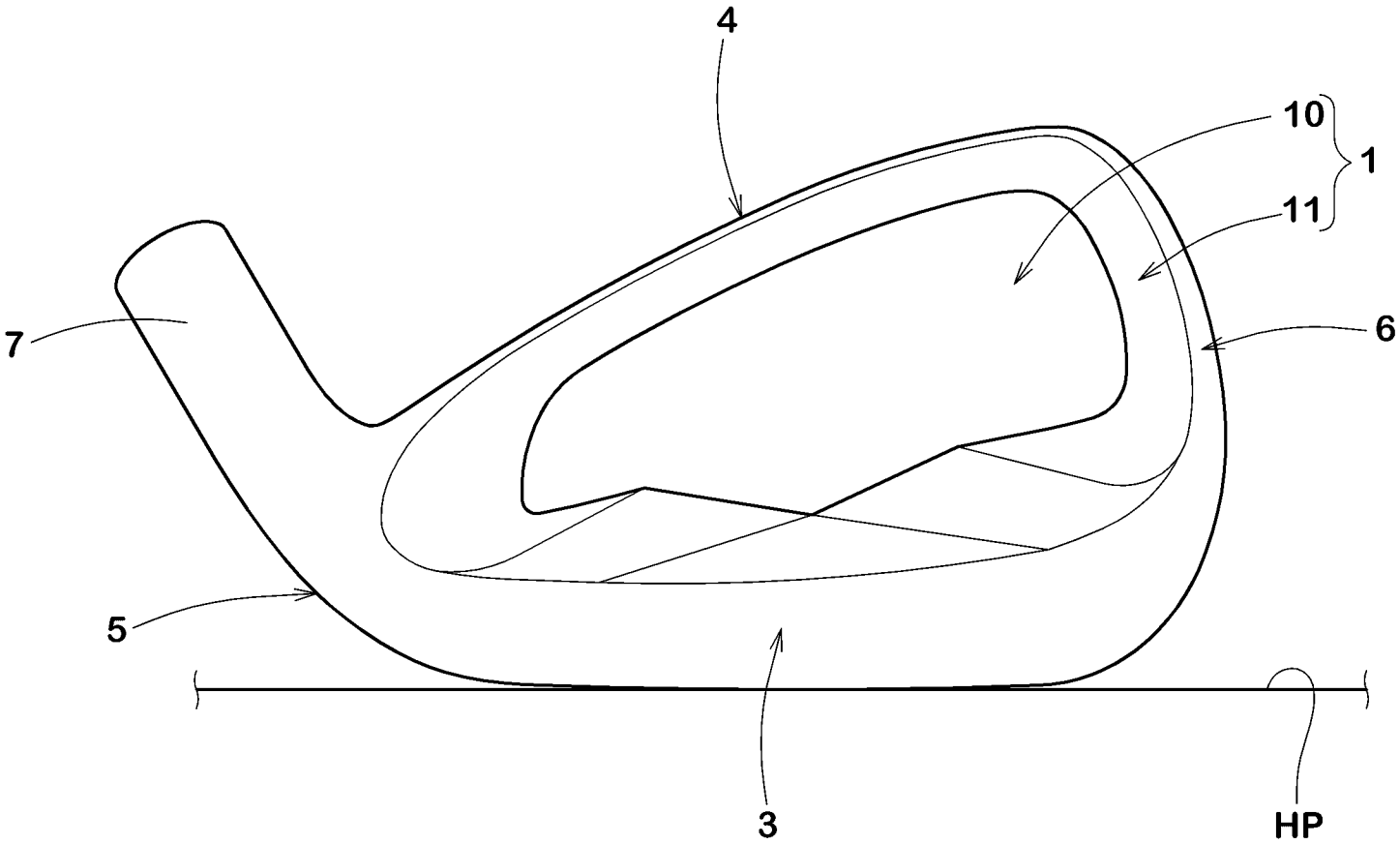
FIG. 2 is a rear view thereof under the upright state.
Figure 3:
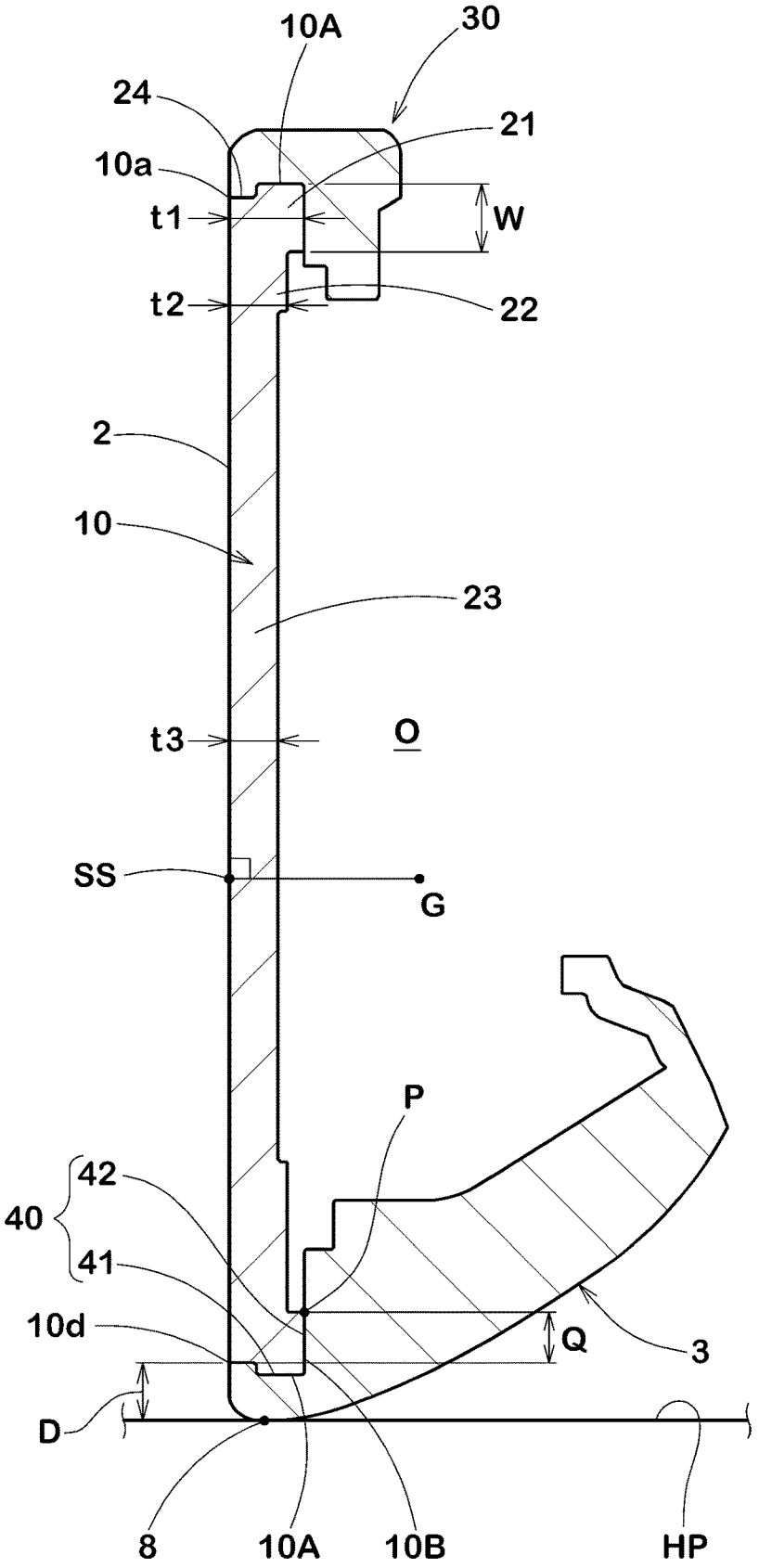
FIG. 3 is a cross sectional view thereof under the upright state taken along line A-A of FIG. 1.
Figure 4:
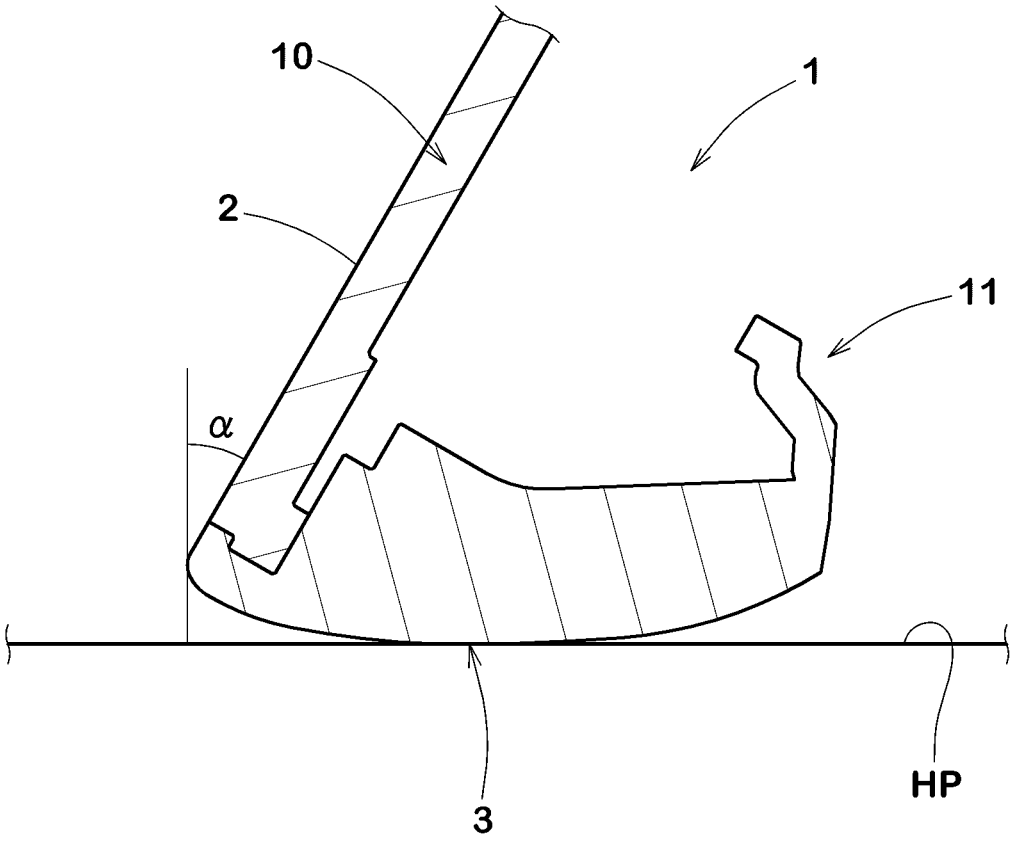
FIG. 4 is a cross sectional partial view of the iron-type golf club head shown in FIG. 1 under its standard state taken along line A-A of FIG. 1.

As shown in FIG. 1 to FIG. 3, an iron-type club head 1, as a first embodiment of the present invention, comprises a flat club face 2 for hitting a ball, a sole 3 forming the under surface of the club head, a top 4 forming the upper surface of the club head, a heel 5 as an end of the club head 1 on the side to which a shaft is attached, a toe 6 as an end of the club head 1 on the opposite side of the heel 5, and a tubular hosel portion 7 to which the shaft is attached.

In the first embodiment, as shown in FIGS. 1 to 3, the club head 1 is composed of a head main body 11 and a face plate 10 fixed thereto.

The face plate 10 has a top-side edge 10*a*, a toe-side edge 10*b*, a heel-side edge 10*c* and a sole-side edge 10*d*, wherein, as shown in FIG. 1, the top-side edge 10*a*, the toe-side edge 10*b* and the sole-side edge 10*d* extend along the profile line of the club face 2 in substantially parallel thereto, and the heel-side edge 10*c* in this example extends in the vertical direction.

The front surface of the face plate 10 forms a major part of the club face 2.

The face plate 10 is provided in the front surface with a plurality of grooves 12 having a small width and a small depth according to the limitations provided in the Golf rules.

The grooves 12 extend straight in parallel with the toe-heel direction.

The grooves 12 increase the frictional coefficient of the club face 2 to give appropriate spin to the hit ball to improve the flying distance.

Given that a grooved range 20 is a range defined as extending between the positions in the toe-heel direction of the most toe-side end 12*a* and most heel-side end 12*b* of the grooves 12, it is not essential but preferable that, in view of variations of ball hitting positions of the average golfers, the width in the toe-heel direction of the grooved range 20 is set in a range of from about 40 mm to about 60 mm, and the grooved range 20 is positioned substantially at the center in the toe-heel direction of the club face 2.

The face plate 10 is made of a titanium or a titanium alloy (hereinafter, generically, "titanium based materials"). Such titanium based materials are, owing to their lower Young's moduli, bent easily when hitting a ball and exhibit good rebound characteristics. Therefore, the use of a titanium based material is preferred.

The titanium of the titanium based material making up the face plate 10 may be an alpha-phase titanium, beta-phase titanium or alpha-beta-phase titanium. It is desirable to use an alpha-beta-phase titanium alloy having high strength such as Ti-5Al-1Fe.

The front surface of the face plate 10 is substantially flat excepting the grooves, namely dents caused thereby. On the other hand, the back surface 10B of the face plate 10 in this example is non-flat or stepped. Thereby, the face plate 10 has multi-thickness changed stepwise. However, the face plate 10 is not to be limited to such configuration.

The face plate 10 in this example comprises a first part 21 extending annularly along the outer circumference or edge of the face plate 10, a second part 22 extending annularly on the inside thereof, and a third part 23 surrounded by the second part 22.

The thickness t1 of the first part 21 is largest, the thickness t3 of the third part 23 is smallest, and the thickness t2 of the second part 22 is therebetween.

The thicknesses of the first part 21, the second part 22 and the third part 23 are decreased step by step.

The third part 23 has an area largest in the face plate 10 and covers substantial ball hitting positions including the sweet spot SS.

The third part 23 having the thickness t3 smallest in the face plate 10 is bent easily, and contributes to improve the rebound performance.

Incidentally, the sweet spot SS is an intersecting point of a normal line, which is drawn from the center of gravity G of the club head to the club face 2, with the club face 2.

The face plate 10 in this example is provided with a concave portion 24 at the corner between the front surface and the outer circumferential surface 10A of the face plate 10.

The concave portion 24 in this example is formed annularly, namely, continuously around the face plate 10.

The concave portion 24 is utilized when the face plate 10 is fixed to the head main body 11 by a caulking technique as described hereinafter.

Figure 5:
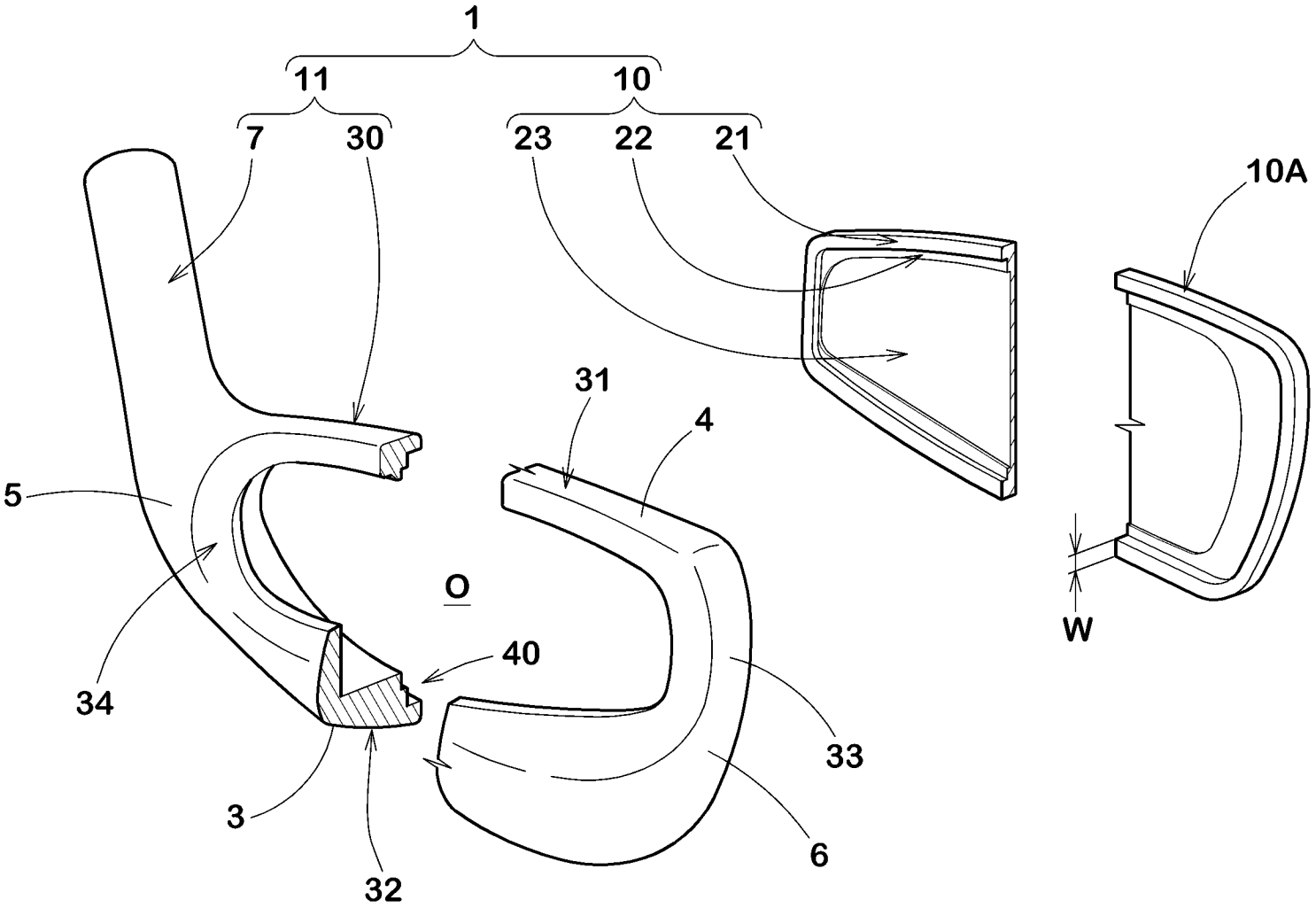
FIG. 5 is an exploded perspective view of the iron-type golf club head.

The head main body 11 in this example includes the hosel portion 7 and a face plate receiving frame 30 as shown in FIG. 5.

The face plate receiving frame 30 extends annularly so as to form a through hole O penetrating the head main body 11 in the front-back direction.

The face plate receiving frame 30 comprises a top frame 31, a sole frame 32, a toe frame 33 and a heel frame 34.

The top frame 31 forms the top 4 of the club head 1.

The sole frame 32 forms the sole 3 of the club head 1.

The toe frame 33 connects between the top frame 31 and the sole frame 32 on the toe 6 side.

The heel frame 34 connects between the top frame 31 and the sole frame 32 on the heel 5 side.

The heel frame 34 is formed integrally with the hosel portion 7. The face plate receiving frame 30 is further provided with a club face mount portion 40 onto which the face plate 10 is mounted.

The club face mount portion 40 is formed annularly surrounding the though hole O as shown in FIG. 3.

The club face mount portion 40 comprises an inner surface 41 facing toward the center of the club head, and a front surface 42 facing toward the club face 2 side of the club head, and the inner surface 41 and the front surface 42 form an internal corner therebetween.

To the inner surface 41, the outer circumferential surface 10A of the face plate 10 is fitted. To the front surface 42, the back surface 10B of the face plate 10 is fitted. Thereby, movements of the face plate 10 in the up-down directions, right-left directions, and backward direction are restrained.

The face plate 10 is fitted in the club face mount portion 40 and finally fixed thereto by joining means, for example, adhesive bonding, press fitting, caulking, welding, fastening screws and the like.

In this example, the face plate 10 is fixed to the club face mount portion 40 by caulking.

Incidentally, the caulking is a technique for fixing the face plate 10 to the club face mount portion 40 by plastically deforming a part of the face plate 10 and/or club face mount portion 40.

Preferably and in this embodiment, after the face plate 10 is fitted in the club face mount portion 40, the face plate receiving frame 30 is partially pressed and plastically deformed so that the deformed part engages with the concave portion 24 of the face plate 10. Thus, the face plate 10 is prevented from being demounted toward the front by the plastically deformed part of the face plate receiving frame 30.

Incidentally, an adhesive agent can be used between the face plate 10 and the head main body 11 when making the caulking operation.

In the first embodiment, the peripheral part of the face plate 10 supported by the head main body 11 is the first part 21 which has the thickness t1 largest in the face plate 10. Therefore, the club head 1 can be improved in the durability of the junction part of the face plate 10 with the club face mount portion 40.

On the other hand, the other part of the face plate 10 (namely, the second part 22 and third part 23) is not supported by the head main body 11.

As the second part 22 and the third part 23 have the relatively small thicknesses t2 and t3, in cooperation with the lower Young's modulus of the titanium based material, these parts 22 and 23 can be elastically deformed when hitting a ball to bent toward the back of the club head without being hindered by the head main body 11. Thereby, the club head 1 in the first embodiment can exhibit further improved rebound performance.

It is preferable that the head main body 11 has a specific gravity more than that of the face plate 10.

The head main body 11 is made of a metal material. For example, a single kind or plural kinds of metal materials selected from stainless steels, maraging steels, Ni-base alloys, soft iron and the like can be used.

It is also possible that the head main body 11 is constructed by two or more separate parts made of different metal materials having different specific gravities.

In this case, it is preferable that a part made of a metal material having a larger specific gravity is incorporated in the sole 3 of the club head main body 11 as a weight member, for example.

Given that the distance D is that of the sole-side edge 10*d* of the face plate 10 measured from the above-mentioned club head sole-side profile line 8 in the up-down direction of the club head under the upright state along the club face 2, the distance D of at least part of the sole-side edge 10*d* positioned in the grooved range 20 is in a range of not more than 2.5 mm.

Thus, the face plate 10 is extended to near the club head sole-side profile line 8 so that the region capable of exhibiting good rebound characteristic is enlarged toward the sole. Accordingly, even if the ball hitting position is on the sole-side of the center or sweet spot, the golfer can enjoy good rebound performance.

Figure 11B:
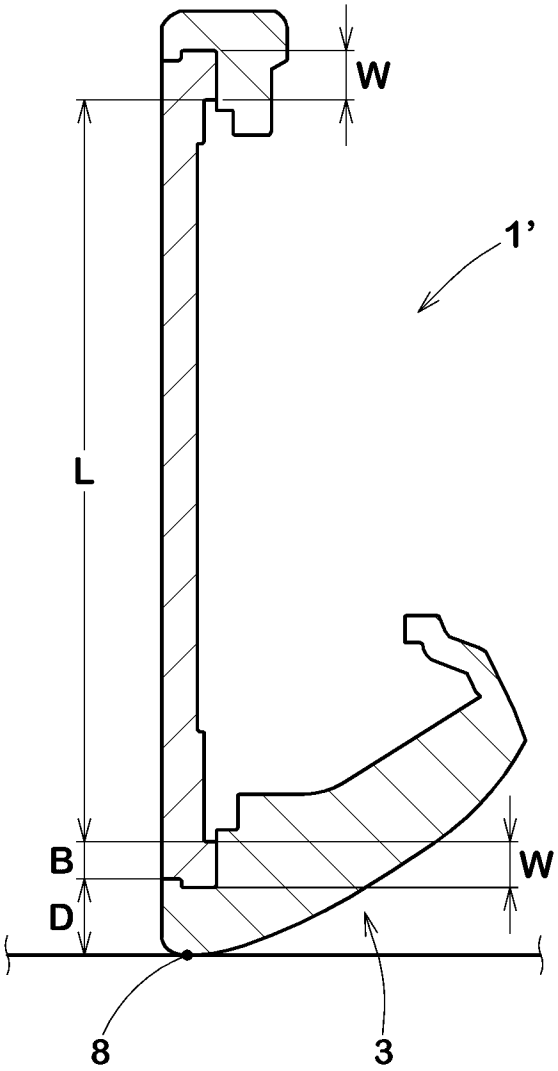
FIGS. 11(*a*) and 11(*b*) are cross sectional views of an iron-type golf club head according to the present invention and a conventional iron-type golf club head, respectively.
Figure 11A:
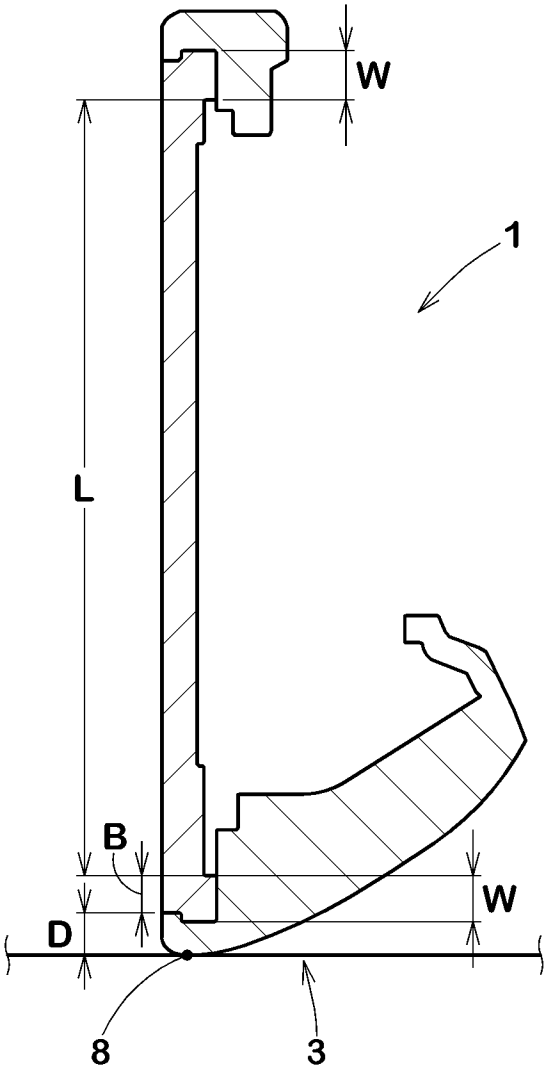

FIGS. 11(*a*) and 11(*b*) show the club head 1 in this embodiment and a conventional club head 1', respectively. Both heads 1 and 1' are the same in respect of the position of the top-side edge of the face plate 10 and the indicated width B. It is necessary that the width B is more than a certain value from the aspect of the strength and the durability.

Although, both heads 1 and 1' have the same width B, the face plate 10 of the club head 1 in this embodiment is provided with a deflectable part L which is larger in the up-down direction than that of the conventional club head 1' by being expanded toward the sole. Therefore, it is possible to provide an iron club which is advantageous to off-center hits on the sole-side of the club face. Thus, even if the ball hitting position is on the sole-side of the club face, the club head 1 in this embodiment can exert high rebound performance, without sacrificing the strength and the durability of the face plate 10. Accordingly, it is possible for the average golfers to improve the carry distance.

For the average golfers, a typical hitting position of iron-type golf club heads is 15 mm above from the club head sole-side profile line 8 along the club face 2.

As the club head 1 in this embodiment has the above described structure, it is possible to increase the restitution coefficient at a position 15 mm above from the club head sole-side profile line 8 along the club face 2 and at the center of the grooved range 20 in the toe-heel direction.

When the restitution coefficient of the club head according to the present invention is measured at a measuring position on the club face 2 at the center in the toe-heel direction of the grooved range 20 which measuring position is spaced apart from the club head sole-side profile line 8 by a distance of 15 mm in the up-down direction along the club face 2, the restitution coefficient is preferably not less than 0.808, more preferably not less than 0.810, still more preferably not less than 0.812.

Here, the restitution coefficient is measured according to the "Procedure for Measuring the Velocity Ratio of a Club Head for conformance to Rule 4-1e, Appendix II, Revision 2 (Feb. 8, 1999), United States Golf Association."

It is preferable that, in the grooved range 20, the distance D of at least part of the sole-side edge 10*d* is not more than 2.4 mm.

It is preferable that a part of the sole-side edge 10*d*, in which the distance D is not more than 2.4 mm, extends in the toe-heel direction across the center in the toe-heel direction of the grooved range 20.

Figure 6:
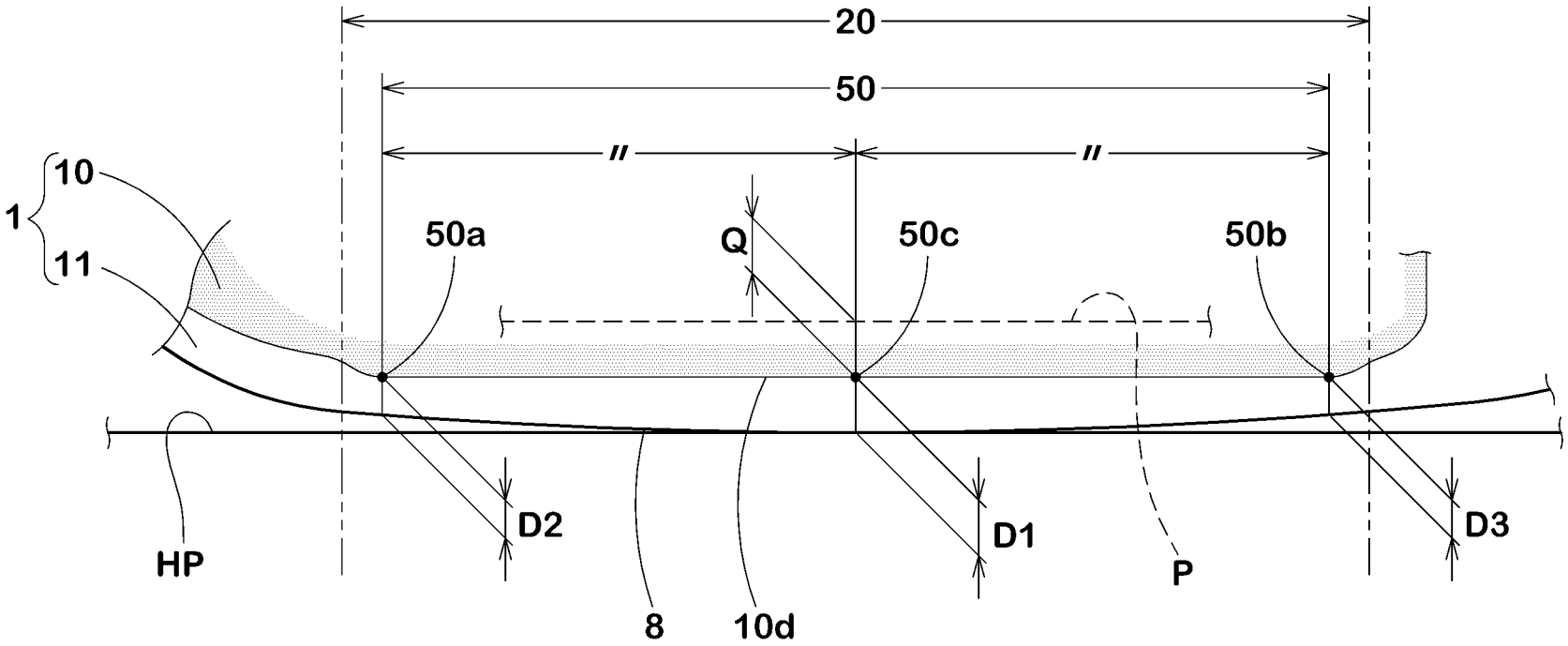
FIG. 6 is a closeup of FIG. 1 showing a sole-side part of the club head.

In the first embodiment, as shown in FIG. 6, the sole-side edge 10*d* of the face plate 10 has a linear part 50 extending linearly in the toe-heel direction and positioned in the grooved range 20.

Preferably, the distance D (D1, D2 and D3 in FIG. 6) of the linear part 50 is not more than 2.5 mm over the entire length of the linear part 50.

Incidentally, the linear part 50 may be utilized as a reference line when making the grooves 12 extending parallel with the toe-heel direction.

In the first embodiment, the club head sole-side profile line 8 appearing when the club face 2 is viewed from the front of the club head 1 is, as shown in FIG. 1, smoothly curved and convex downward.

Due to the convex shape of the club head sole-side profile line 8 and the sole-side edge 10*d* of the face plate 10 including the linear part 50, the distance D of the linear part 50 is gradually decreased from the center 50*c* of the linear part 50 toward the toe-side end 50*a* and the heel-side end 50*b* of the linear part 50.

In order to effectively improve the rebound performance of the club face 2 in its sole-side part, the distance D1 of the sole-side edge 10*d* at the center 50*c* of the linear part 50 is preferably set in a range of not more than 2.5 mm, more preferably not more than 2.4 mm, still more preferably not more than 2.3 mm. And, at the toe-the side end 50*a* and the heel-side end 50*b* of the linear part 50, the distances D2 and D3, respectively, of the sole-side edge 10*d* of the face plate 10 are preferably set in a range of not more than 2.1 mm, more preferably not more than 2.0 mm, still more preferably not more than 1.9 mm.

In the first embodiment, as explained above, the sole-side edge 10*d* of the face plate 10 is positioned on the upper side of the club head sole-side profile line 8. Therefore, as an example, a caulking technique utilizing the concave portion 24 is available over the entire circumference of the face plate 10. Accordingly, the club head 1 can achieve both of high rebound performance and good durability in a sole-side region of the club face.

In the first embodiment, in order to effectively derive this advantage effect, it is preferred that the minimum of the distance D of the sole-side edge 10*d* of the face plate 10 from the club head sole-side profile line 8 is set in a range of not less than 1.5 mm, more preferably not less than 1.8 mm.

In order to improve the rebound performance by enlarging the face plate 10 toward the toe 6, the distance D4 between the toe-side edge 10*b* of the face plate 10 and the outer edge of the club face 2 is preferably set in a range of not more than 2.5 mm, more preferably not more than 2.3 mm, still more preferably not more than 2.0 mm when the club face 2 is viewed from its front.

In order to improve the rebound performance by enlarging the face plate 10 toward the top 4, the distance D5 between the top-side edge 10*a* of the face plate 10 and the outer edge of the club face 2 is preferably set in a range of not more than 2.8 mm, more preferably not more than 2.6 mm when the club face 2 is viewed from its front.

Preferably, the distance D4 is equal to or less than the distance D5.

In order to further improve the rebound performance of the club head 1, the thickness t3 of the third part 23 of the face plate 10 is preferably not less than 1.6 mm, more preferably not less than 1.8 mm, but preferably not more than 2.5 mm, more preferably not more than 2.3 mm, and the thickness t2 of the second part 22 is preferably not less than 2.1 mm, more preferably not less than 2.3 mm, but preferably not more than 2.9 mm, more preferably not more than 2.7 mm.

In order to increase the strength of the junctional part of the face plate 10 with the head main body 11 while improving the rebound performance of the club head 1,
the thickness t1 of the first part 21 of the face plate 10 is preferably not less than 3.0 mm, more preferably not less than 3.1 mm, but preferably not more than 3.5 mm, more preferably not more than 3.4 mm, and the width w of the first part 21 is preferably not less than 1.3 mm, more preferably not less than 1.5 mm, but preferably not more than 2.7 mm, more preferably not more than 2.5 mm.

In the example shown in FIG. 3, in order to enlarge the deflectable part L (shown in FIG. 11) of the club head 1 toward the sole without deteriorating the durability of the club head, the height Q in the up-down direction between the sole-side edge 10*d* and the upper edge P of the contact surface of the face plate 10 with the head main body 11 is preferably not less than 0.8 mm, more preferably not less than 1.1 mm, but preferably not more than 2.2 mm, more preferably not more than 2.0 mm.

Figure 7:
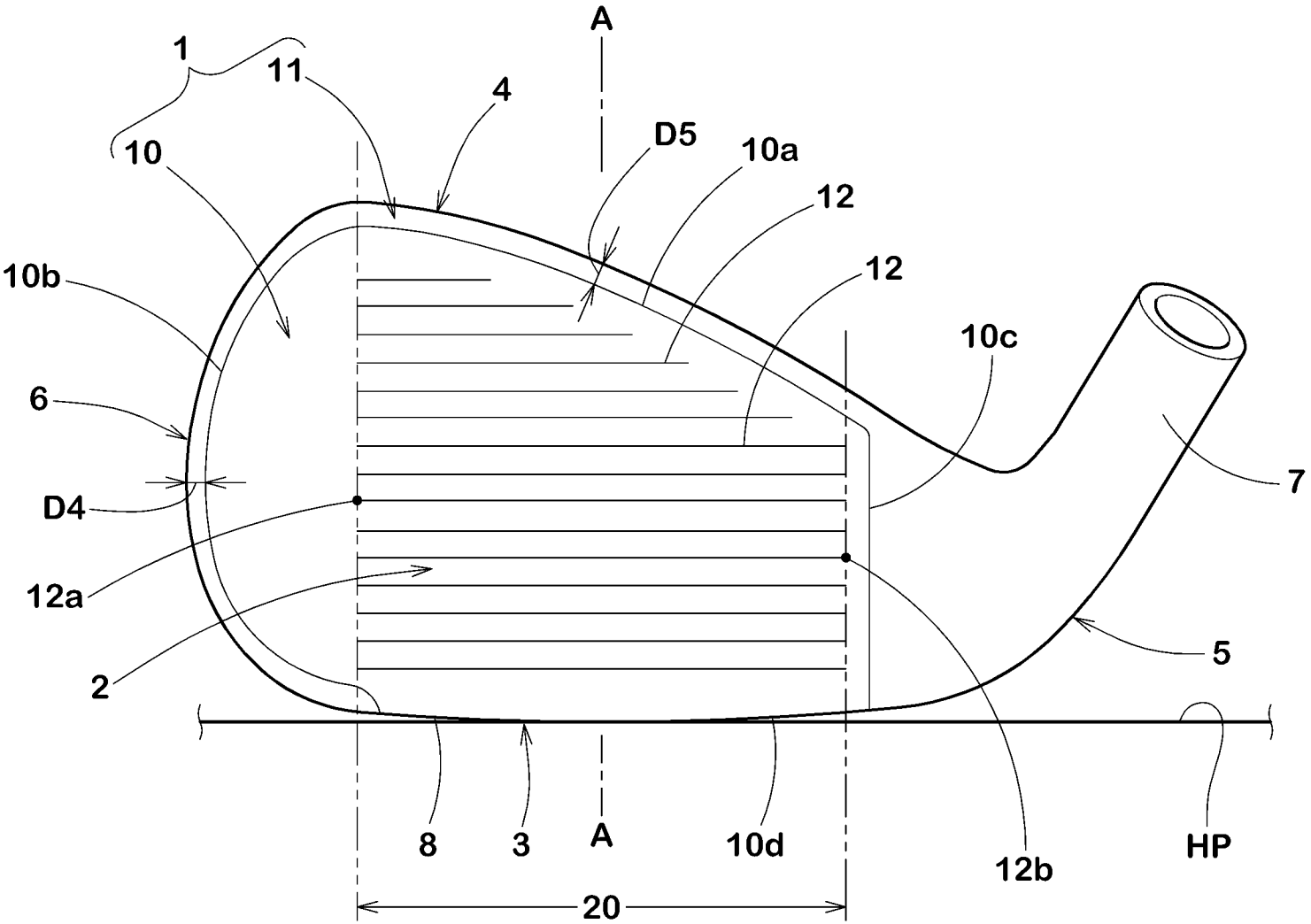
FIG. 7 is a front view of an iron-type golf club head as a second embodiment of the present invention under the upright state of the club head.
Figure 8:
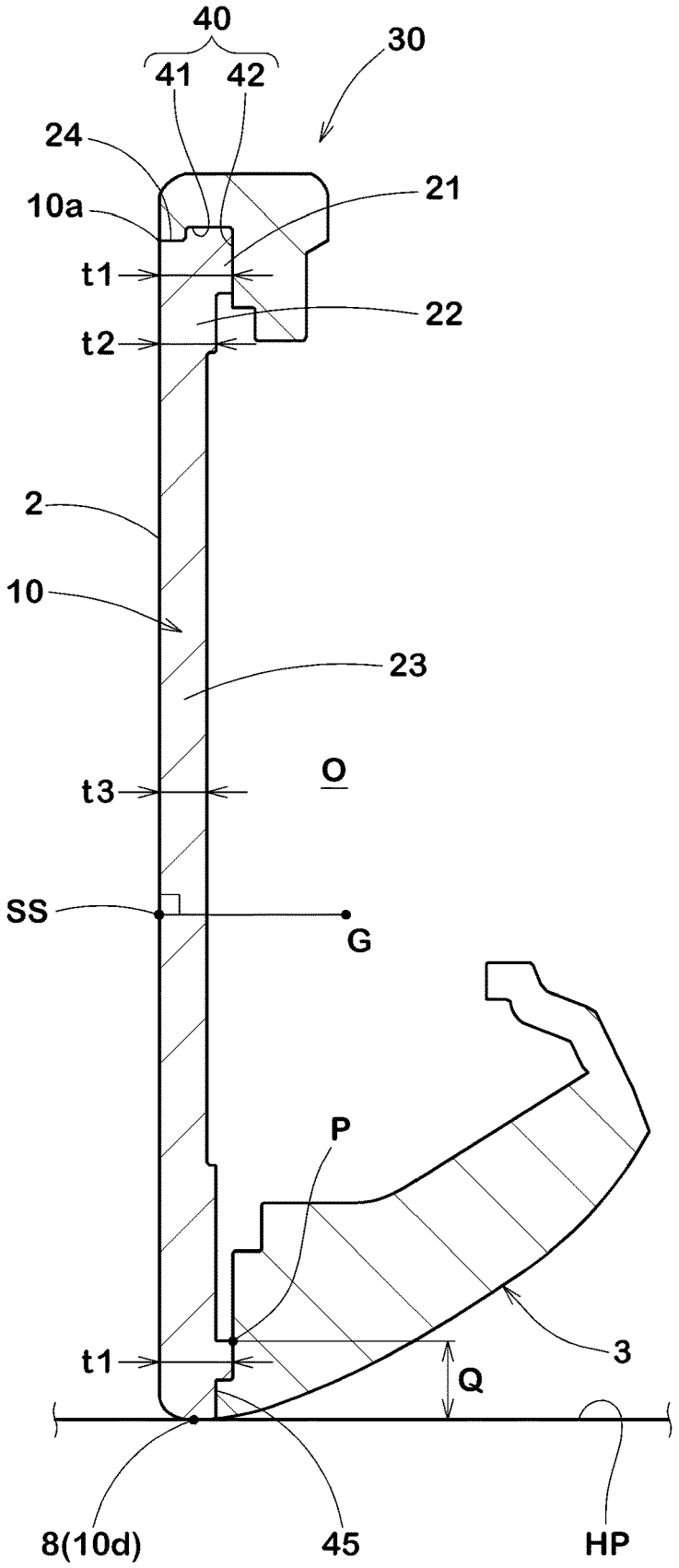
FIG. 8 is a cross sectional view thereof under the upright state taken along line A-A of FIG. 7.

FIG. 7 and FIG. 8 show an iron-type club head 1 as a second embodiment of the present invention.

The second embodiment will be described hereunder wherein, for the parts corresponding to those in the first embodiment, the same reference numbers are used, and redundant descriptions are omitted.

In the second embodiment, at least part of the sole-side edge 10*d* in the grooved range 20 forms the club head sole-side profile line 8.

The top-side edge 10*a*, the toe-side edge 10*b* and the heel-side edge 10*c* of the face plate 10 are positioned inside the outer edge of the club face 2 as shown in FIG. 7.

But, the sole-side edge 10*d* of the face plate 10 reaches the sole 3 and is exposed in the surface of the sole 3 to form a front part of the sole 3 as shown in FIG. 8. Thereby, a part of the sole-side edge 10*d* of the face plate 10 forms the club head sole-side profile line 8.

Thus, the face plate 10 is further enlarged toward the sole in comparison with the first embodiment, and the rebound performance in the sole-side part of the club face can be further improved.

Similarly to the first embodiment, the top-side edge 10*a*, the toe-side edge 10*b* and the heel-side edge 10*c* of the face plate 10 are firmly fixed to the club face mount portion 40 by caulking. Thereby, movements of the face plate 10 in the up-down directions, right-left directions, and backward direction are restrained.

In the second embodiment, since a major part of the sole-side edge 10*d* of the face plate 10 forms the club head sole-side profile line 8, it is difficult to cover and secure the sole-side edge 10*d* of the face plate 10 from the front side of the face plate by the plastically deformed part of the club head main body 11.

Therefore, it is preferable that, as shown in FIG. 8, the sole-side edge 10*d* of the face plate 10 is provided at the rear corner with a concave portion 45 formed by cutting out the rear corner.

The concave portion 45 is formed by two surfaces, namely, a front surface and an upper surface in the cross section.

In the example shown in FIG. 8, the front surface is parallel with the club face, and the upper surface is perpendicular to the club face.

Figure 9:
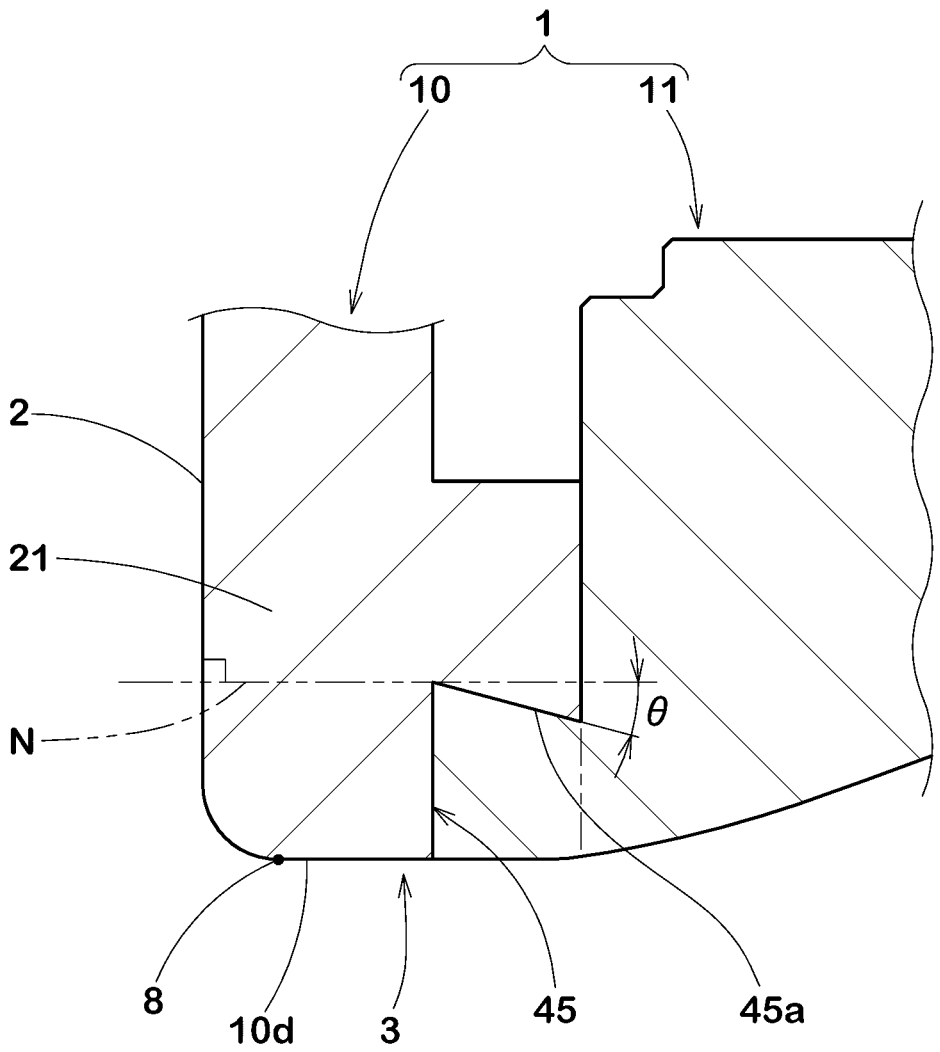
FIG. 9 is an enlarged cross sectional view showing a modification of the junction structure of the face plate and the head main body of the second embodiment.

FIG. 9 shows a modification of the concave portion 45 shown in FIG. 8.

In the example shown in FIG. 9, the front surface is parallel with the club face, and the upper surface is a slant surface 45*a* which is inclined with respect to the direction N perpendicular to the club face, downwardly toward the back of the club head.

In eighth case, the concave portion 45 is filled with a part of the club head main body 11 protruding frontward to engaged with each other. This protruding part can be a plastically deformed part of the club head main body 11.

The slant surface 45*a* is particularly preferable in order to prevent the face plate 10 from being dislocated toward the front and serve to achieve both of good rebound performance and high durability.

While detailed description has been made of especially preferable embodiments of the present invention, the present invention can be embodied in various forms without being limited to the illustrated embodiments.

Comparison Tests

Based on the structures shown in FIG. 1 to FIG. 8, iron-type golf club heads having specifications listed in Table 1 were experimentally manufactured and measured for the restitution coefficient.

Common specifications are as follows.

Club head: for six iron

Lie angle: 61.5 degrees

Loft angle: 27 degrees

Face plate material: titanium alloy (Ti-5Al-1Fe)

first part width W: 2.5 mm first part thickness t1: 3.25 mm second part thickness t2: 2.55 mm third part thickness t3: 2.15 mm height Q: 2.0 mm Head main body material: stainless steel (SUS630)

The restitution coefficient was measured according to the "Procedure for Measuring the Velocity Ratio of a Club Head for Conformance to Rule 4-1e, Appendix II, Revision 2 (Feb. 8, 1999), United States Golf Association". But, instead of the sweet spot, the measuring position was 15 mm upward from the sole-side profile line of the club face along the club face and at the center in the toe-heel direction of the grooved range of the club face.

As explained above, such measure position reflects actual hitting positions of the average golfers.

The results are show in Table 1, wherein the larger the value, the better the restitution coefficient.

TABLE 1

| Head | comparative example 1 | comparative example 2 | comparative example 3 | working example 1 |
|---|---|---|---|---|
| distance D1 (mm) | 3.3 | 4.3 | 3.1 | 2.3 |
| distance D2 (mm) | 2.8 | 3.8 | 2.6 | 1.9 |
| distance D3 (mm) | 2.8 | 3.8 | 2.8 | 1.9 |
| distance D4 (mm) | 2.0 | 2.0 | 2.5 | 2.0 |
| distance D5 (mm) | 2.5 | 1.5 | 2.0 | 2.5 |
| restitution coefficient (measured value) | 0.804 | 0.792 | 0.805 | 0.812 |
| restitution coefficient (relative value) | 100 | 98.507 | 100.124 | 100.995 |

| Head | working example 2 | working example 3 | working example 4 |
|---|---|---|---|
| distance D1 (mm) | 2.4 | 2.5 | 0 |
| distance D2 (mm) | 2.0 | 2.1 | 0 |
| distance D3 (mm) | 2.0 | 2.1 | 0 |
| distance D4 (mm) | 2.0 | 2.0 | 2.0 |
| distance D5 (mm) | 2.5 | 2.5 | 2.5 |
| restitution coefficient (measured value) | 0.810 | 0.808 | 0.817 |
| restitution coefficient (relative value) | 100.746 | 100.498 | 101.617 |

Form the test results, it was confirmed that, in comparison with the comparative examples, the working examples according to the invention were significantly improved in the rebound performance at typical hitting positions of the average golfers.

Further, working example 1 and comparative examples 1 and 2 were each measured for the restitution coefficient of the club face at various measure positions. The measure positions were on the center line (center in the toe-heel direction) of the grooved range of the club face and in a range between 4 mm and 25 mm above from the above-mentioned sole-side profile line of the club head.

Figure 10:
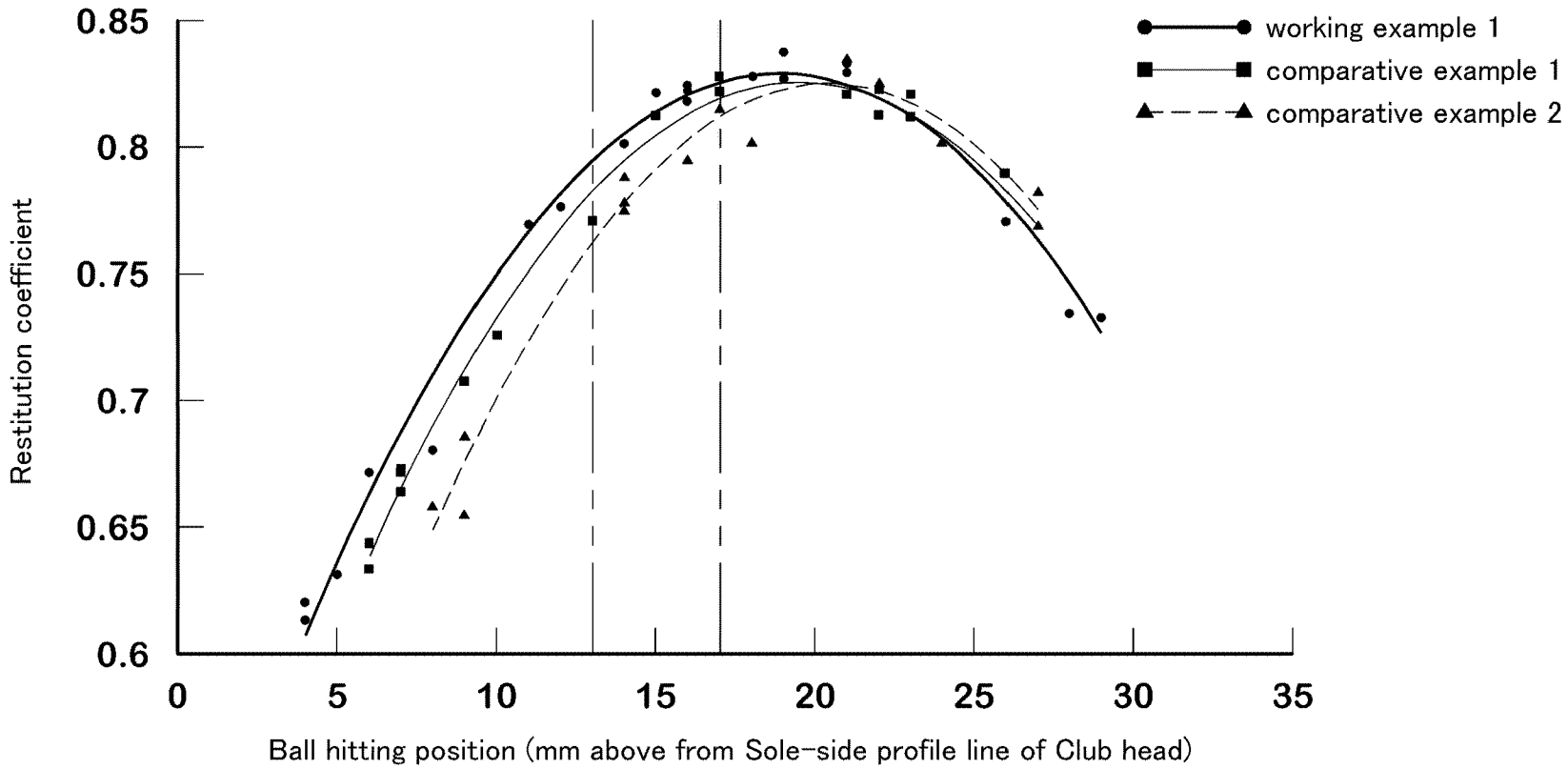
FIG. 10 is a graph showing a relationship between restitution coefficients and ball hitting positions.

FIG. 10 shows the results of measurements, wherein the measured values are plotted, and polynomial approximate curves therefor are also shown. The axis of ordinate denotes the restitution coefficient, and the axis of abscissas denotes the distance in millimeter of the measuring position above from the sole-side profile line.

As shown in FIG. 10, the club head as working example 1 exhibited the restitution coefficient of more than 0.790 at hitting positions in a range between plus/minus 2 mm of the center of the distribution of the typical hitting positions of the average golfers, and it was confirmed that, in comparison with the comparative examples 1 and 2, the restitution coefficient of working example 1 was significantly increased. Further, in the club head as working example 1, the maximum (about 0.828) of the restitution coefficient occurred at a position of less than 20 mm above from the sole-side profile line, whereas the maximum of the restitution coefficient of comparative examples 1 and 2 occurred at positions more than 20 mm above from the sole-side profile line. Thus, it was confirmed that working example 1 was improved in the rebound performance in the sole-side part of the club face.

REFERENCE SIGNS LIST

1 iron-type golf club head
2 club face
3 sole
8 club head sole-side profile line
10 face plate
10*d* sole-side edge
11 head main body
12 groove
20 grooved range
50 linear part

The invention claimed is:

1. A golf club head for an iron club having a club face for hitting a ball and a sole forming an under surface of the club head, comprising:

a face plate made of a titanium or alternatively a titanium alloy and having a front surface forming a part of the club face and being provided with a plurality of grooves extending in a direction from a toe to a heel of the club head and each having a toe-side end and a heel-side end positioned within said front surface, and a head main body made of a metal material having a specific gravity larger than that of the face plate and supporting a peripheral part of the face plate, wherein:

a width in a toe-heel direction of the club head of a part of the front surface of the face plate which part is provided with the plurality of grooves is defined as a grooved range, and the grooved range is between a position in the toe-heel direction of a most toe-side end of the grooves and a position in the toe-heel direction of a most heel-side end of the grooves, in a front view of the club head under its upright state, a distance measured in a direction from up to down of the club head under the upright state of the club head between a sole-side edge of the face plate which appears in the front view of the club head and a sole-side portion of a profile line of the club head which profile line appears in the front view of the club head under the upright state is zero in at least part of the sole-side edge, wherein said at least part of the sole-side edge forms at least part of the sole-side portion of the profile line, the face plate has its outer edge in said front view which includes said sole-side edge, a top-side edge, a toe-side edge and a heel-side edge, and in the front view of the club head under the upright state, the top-side edge, the toe-side edge and the heel-side edge are positioned inside an outer edge of the club face, and the face plate has, on its sole-side, a contact surface with the head main body, and a height (Q) of an upper edge of the contact surface from the sole-side edge of the face plate is in a range of from 0.8 to 2.2 mm when measured in the up-down direction in the front view of the club head under the upright state, wherein the upright state is such that the club head under a standard state is rotated around a horizontal axis extending along the club face so that a loft angle of the club head becomes 0 degree, and the standard state is such that the club head is set on a horizontal plane so that a center line of a shaft inserting hole of the club head to which a club shaft is attached, is inclined at a lie angle specified for the club head while keeping said center line on a vertical plane, and the club face forms a loft angle specified for the club head, the toe-heel direction is a direction parallel with the horizontal plane and perpendicular to a front-back direction, and the front-back direction is a direction parallel with a straight line projected on the horizontal plane, wherein the straight line is drawn normally to the club face passing through the center of gravity of the club head.

2. The golf club head according to claim 1, wherein said at least part of the sole-side edge extends in the toe-heel direction across the center in the toe-heel direction of the grooved range.

3. The golf club head according to claim 1, wherein the sole-side edge includes a linear part extending linearly along the toe-heel direction, and in the grooved range, said distance in the linear part is zero.

4. The golf club head according to claim 2, wherein the sole-side edge includes a linear part extending linearly along the toe-heel direction, and in the grooved range, said distance in the linear part is zero.

5. The golf club head according to claim 1, wherein said outer edge of the face plate consists of the sole-side edge, the top-side edge, the toe-side edge and the heel-side edge, the distance D4 between the toe-side edge of the face plate and said outer edge of the club face is in a range of not more than 2.5 mm, and the distance D5 between the top-side edge of the face plate and said outer edge of the club face is in a range of not more than 2.8 mm.

6. The golf club head according to claim 5, wherein the distance D4 is equal to or less than the distance D5.

7. The golf club head according to claim 5, wherein in said contact surface of the face plate, a rear corner of the face plate is provided with a concave portion, and the head main body is provided with a part protruding frontward to fit into the concave portion.

8. The golf club head according to claim 1, wherein in said contact surface of the face plate, a rear corner of the face plate is provided with a concave portion, and the head main body is provided with a part protruding frontward to fit into the concave portion.

* * * * *